US008245327B2

(12) United States Patent
Wilson, II

(10) Patent No.: US 8,245,327 B2
(45) Date of Patent: Aug. 21, 2012

(54) ATHLETIC UNDERGARMENT AND PROTECTIVE CUP ASSEMBLY

(75) Inventor: Ronald L. Wilson, II, Solana Beach, CA (US)

(73) Assignee: Power & HonorIPHoldings, LLC, Deerfield Beach, FL (US)

( * ) Notice: Subject to any disclaimer, the term of this patent is extended or adjusted under 35 U.S.C. 154(b) by 267 days.

(21) Appl. No.: 12/432,265

(22) Filed: Apr. 29, 2009

(65) Prior Publication Data

US 2010/0275349 A1 Nov. 4, 2010

(51) Int. Cl.
*A41D 13/00* (2006.01)
*A41D 27/26* (2006.01)

(52) U.S. Cl. ..... 2/466

(58) Field of Classification Search ..... 2/466, 215, 2/223, 231, 401, 403, 404; 602/60, 61, 67, 602/68, 69, 70, 71, 72, 73; 128/876, 883, 128/891

See application file for complete search history.

(56) References Cited

U.S. PATENT DOCUMENTS

| | | | | |
|---|---|---|---|---|
| 441,637 | A | 12/1890 | Bloch | |
| 849,471 | A | 4/1907 | Gamble | |
| 1,691,658 | A | 11/1928 | Kennedy | |
| D86,113 | S | 2/1932 | Dwyer | |
| 1,898,606 | A | 2/1933 | Whitley | |
| 1,999,078 | A | 4/1935 | Douglas et al. | |
| 2,138,643 | A | 11/1938 | Oppenheim | |
| 2,489,083 | A | 11/1949 | Dubin | |
| 2,903,707 | A | 9/1959 | Schimmel et al. | |
| 3,098,238 | A | 7/1963 | Diamond | |
| 3,207,155 | A * | 9/1965 | Casey | 602/67 |
| 3,782,375 | A | 1/1974 | Donars | |
| 3,788,314 | A | 1/1974 | Noreen | |
| 4,014,044 | A | 3/1977 | Figueroa et al. | |
| 4,134,400 | A | 1/1979 | DiMatteo | |
| D292,340 | S | 10/1987 | Sjoholm | |
| 4,811,427 | A | 3/1989 | Regan | |
| 4,922,899 | A | 5/1990 | Graff et al. | |
| 5,105,473 | A | 4/1992 | Valtakari | |
| 5,105,474 | A | 4/1992 | Skinner | |
| 5,255,392 | A | 10/1993 | Stanislaw | |
| 5,274,854 | A | 1/1994 | Wenner et al. | |
| 5,483,705 | A * | 1/1996 | DiMatteo | 2/466 |
| 5,539,926 | A | 7/1996 | Mantos | |
| 5,598,586 | A | 2/1997 | Munjone | |

(Continued)

FOREIGN PATENT DOCUMENTS

| | | |
|---|---|---|
| JP | 09021006 | 1/1997 |

(Continued)

*Primary Examiner* — Alissa L Hoey
*Assistant Examiner* — Amber Anderson
(74) *Attorney, Agent, or Firm* — Dan De La Rosa

(57) ABSTRACT

An athletic undergarment and a protective cup assembly is provided. The undergarment includes a cup pocket for holding the protective cup over the groin of the wearer. The cup includes an attachment location in a lower portion to secure a first end of a strap. The cup pocket defines a slit in a bottom portion of the cup pocket sized to allow the strap to pass therethrough. The coupling mechanism is provided having a first portion on the strap and a second portion disposed in a rear portion of the undergarment proximate to the waistband. In use, the strap extends between the legs portions so that the first portion and the second portion of the coupling mechanism can couple in a secure manner to inhibit displacement of the cup when exposed to upward forces.

17 Claims, 4 Drawing Sheets

U.S. PATENT DOCUMENTS

| | | | | |
|---|---|---|---|---|
| 5,675,842 | A | 10/1997 | Schaefer | |
| D403,400 | S | 12/1998 | Bernard et al. | |
| 6,023,789 | A | 2/2000 | Wilson et al. | |
| 6,041,441 | A | 3/2000 | Counts et al. | |
| 6,108,819 | A | 8/2000 | DeBaene et al. | |
| 6,532,599 | B1 | 3/2003 | Dugan | |
| 6,622,719 | B1 * | 9/2003 | Slautterback et al. | 128/98.1 |
| 6,665,882 | B1 | 12/2003 | Pedrick | |
| 6,735,785 | B2 | 5/2004 | Takayama | |
| 6,789,270 | B1 | 9/2004 | Pedrick | |
| 6,859,944 | B2 | 3/2005 | Kim | |
| 7,124,448 | B2 | 10/2006 | Davenport | |
| 7,178,176 | B1 | 2/2007 | S-Cronenbold | |
| 7,216,371 | B2 | 5/2007 | Wong | |
| 7,296,307 | B2 | 11/2007 | Atwater et al. | |
| 7,404,216 | B1 | 7/2008 | Paramore | |
| 7,418,743 | B2 | 9/2008 | Tsujimoto | |
| 7,523,508 | B2 | 4/2009 | Contant et al. | |
| 2003/0051288 | A1 * | 3/2003 | Dugan | 2/228 |
| 2004/0024341 | A1 | 2/2004 | Jacobs | |
| 2005/0066424 | A1 | 3/2005 | Salazer | |
| 2005/0177931 | A1 * | 8/2005 | Tsujimoto | 2/466 |
| 2005/0268387 | A1 | 12/2005 | Wong | |
| 2008/0271229 | A1 | 11/2008 | Steszyn et al. | |

FOREIGN PATENT DOCUMENTS

| | | |
|---|---|---|
| JP | 2001248005 | 9/2001 |
| WO | WO 0224011 | 3/2002 |
| WO | WO 04-000051 | 12/2003 |

* cited by examiner

ATHLETIC UNDERGARMENT AND PROTECTIVE CUP ASSEMBLY

FIELD OF THE INVENTION

The present invention relates generally to athletic undergarment and, more particularly, athletic shorts configured to receive a protective athletic cup.

BACKGROUND OF THE INVENTION

Protective cups have long been used in sporting activities to protect the groin from impact. Undergarments have often been configured to hold such protective cup in place. Typically, such undergarments include a pocket in the groin area to hold the protective cup. The undergarment can further include straps attached to the pocket to aid holding the protective cup in place.

Although such undergarments and protective cups are generally effective, shortfalls exist. For example, combat sports often expose the wearer to upward blows to the groin areas. Current configurations tend to provide minimal protection for such blows. When current configurations are exposed to an upward blow, the protective cup can become dislodged from its required location. Instead, the protective cup can move within the pocket, moving relative to the groin of the wearer. As a result, the wearer can be exposed to substantial force in the groin area, risking serious injury.

It should be appreciated that there remains a need for an undergarment and protective cup assembly that addresses these concerns. The present invention fulfills this need and others.

SUMMARY OF THE INVENTION

In general terms, the invention discloses an athletic undergarment and a protective cup assembly. The undergarment includes a cup pocket for holding the protective cup over the groin of the wearer. The cup includes an attachment location in a lower portion to secure a first end of a strap. The cup pocket defines a slit in a bottom portion of the cup pocket sized to allow the strap to pass therethrough. The coupling mechanism is provided having a first portion on the strap and a second portion disposed in a rear portion of the undergarment proximate to the waistband. In use, the strap extends between the legs portions so that the first portion and the second portion of the coupling mechanism can couple in a secure manner to inhibit displacement of the cup when exposed to upward forces.

More specifically, and by way of example in an embodiment of the invention, the cup includes three attachment locations for securing three straps. The straps extend out corresponding slits defined in an outer panel of the cup pocket of the undergarment. The straps to attach coupling portions disposed on the exterior surface of the undergarment.

In one embodiment of the invention, the straps include a first portion of hook-and-loop material, and the undergarment includes patches of a second portion of hook-and-loop material disposed on the exterior surface such that the straps can be secure to the exterior surface of the undergarment.

In a detailed aspect of another embodiment, the attachment locations of the protective cup are defined by elongated apertures that enable the straps to be threaded therethrough.

In another detailed aspect of yet another embodiment, the exterior surface of the protective cup defines a plurality of raised portions and a recess disposed between the raised portions. The cup can further include a rigid shell sized to conform within the recess between the raised portions of the protective cup.

In yet another detailed aspect of still yet another embodiment, the undergarment includes patches in (a) a rear portion of the undergarment proximate to the waistband to secure the first strap, (b) a front, left portion of the undergarment proximate to the waistband to secure the second strap, and (c) a front, right portion of the undergarment proximate to the waistband to secure the third strap.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

BRIEF DESCRIPTION OF THE DRAWINGS

Embodiments of the present invention will now be described, by way of example only, with reference to the following drawings in which.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
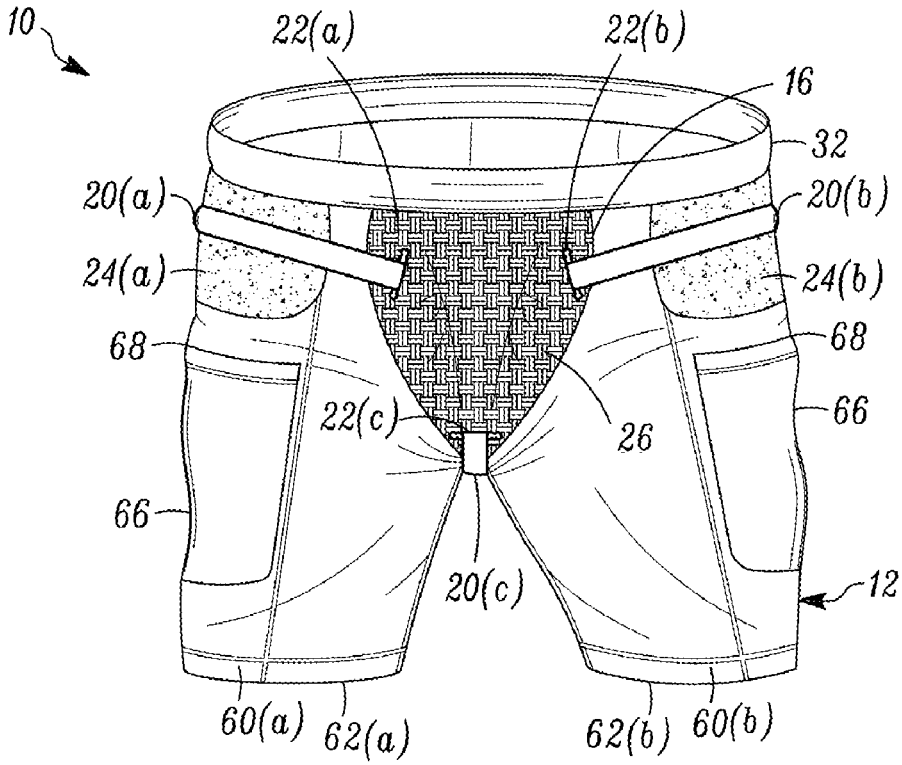
FIG. 1 is a front perspective view of an undergarment and protective cup system in accordance with the present invention, depicting the protective cup (in phantom) disposed in a cup pocket.
Figure 2:
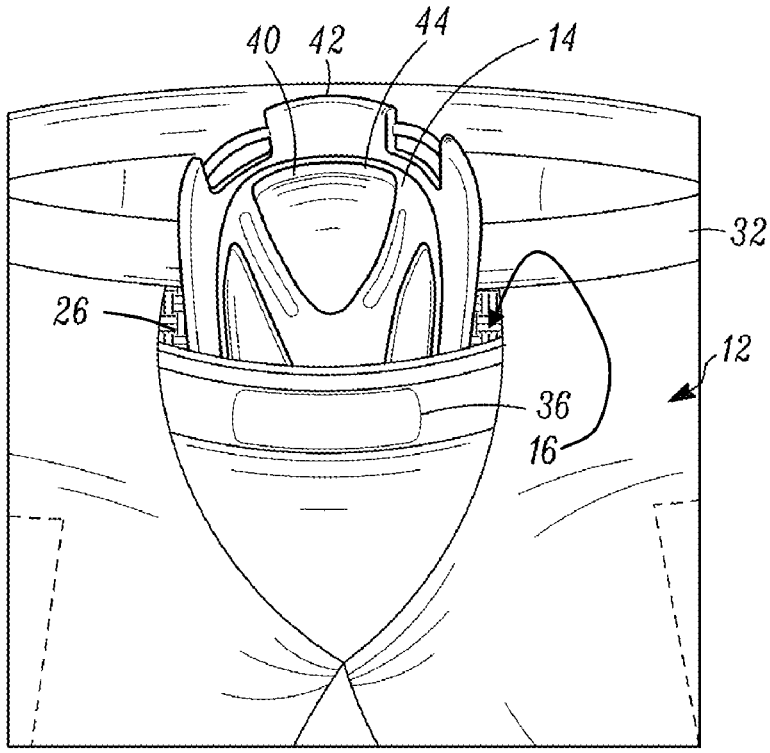
FIG. 2 is a perspective view of the interior side of the undergarment of FIG. 1, depicting an interior panel and opening for the cup pocket.

Referring now to the drawings, and particularly to FIGS. 1 and 2, there is shown a system 10 having an athletic undergarment 12 and a protective cup 14 assembly. The undergarment includes a cup pocket 16 for holding the protective cup over the groin of the wearer. The cup includes attachment locations 18*a-c* spaced about the periphery of the cup to secure straps 20*a-c*. The straps extend out slits 22*a-c* of the cup pocket to attach coupling portions, patches 24*a-c*, disposed on the exterior surface of the undergarment. The straps are configured to hold the cup securely in place during use, to inhibit displacement of the cup even when exposed to upward forces.

With continued reference to FIG. 1, the cup pocket 16 includes an outer panel 26 that defines three slits 22*a-c* for each of the straps 20*a-c*. Each strap of straps 20*a-c* includes a first end (i.e., first ends 28*a-c*, respectively, FIG. 5) attached to the protective cup 16 and a second end (i.e., second 30*a-c*, respectively, FIG. 4)) attached to an exterior side of the undergarment 12. The second ends of the straps each include a first portion of hook-and-loop material. A second portion of the hook-and-loop material is disposed at a prescribed location on the exterior side of the undergarment. In one embodiment, the hook fabric is disposed on the straps, and three patches 24*a-c* of loop fabric are disposed at prescribed locations on the exterior side of the undergarment, namely, proximate to each hip and in a rear portion of the undergarment.

Figure 4:
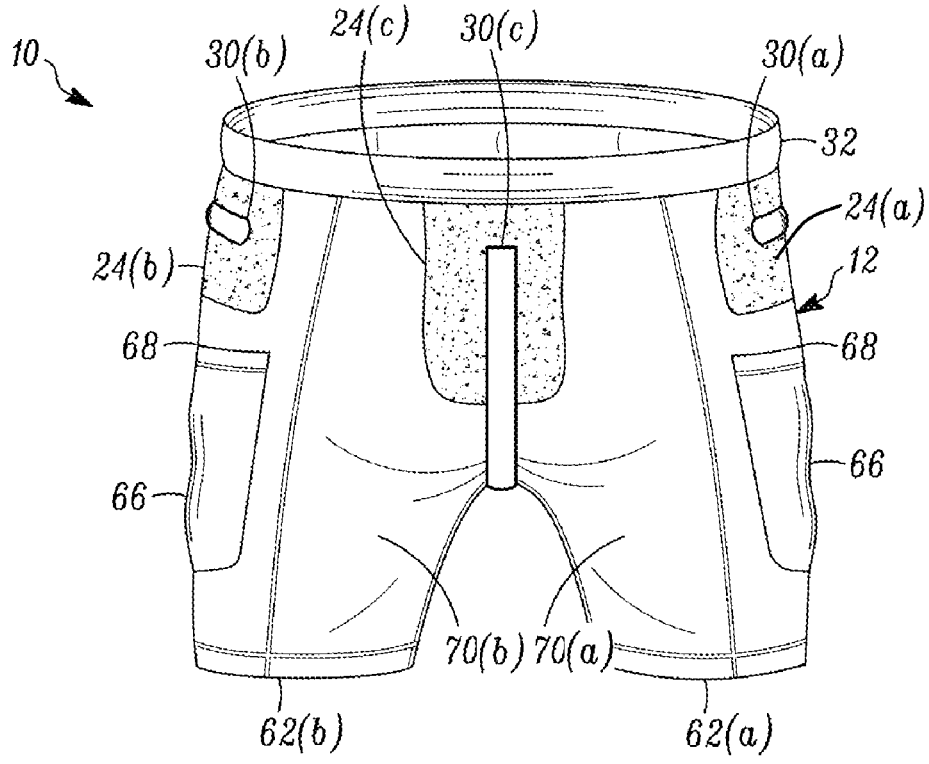
FIG. 4 is a rear view of the undergarment and protective cup system of FIG. 1, depicting an attachment location on an exterior side of the undergarment for a first strap of the protective cup.

In use, the upper straps 20*a,b* attach to the side patches 24*a,b*, and the bottom strap 20*c* attaches to the rear patch 24*c* (FIG. 4). In other embodiments, various other coupling mechanisms can be used to attach the straps to the undergarment, such as buckles, snaps, rivets, and so on.

As best seen in FIG. 2, an interior side of the cup pocket 16 is shown. The cup pocket defines an upper opening for receiving the protective cup 14. The cup pocket includes a closure 36 formed of hook-and-loop material to secure the pocket. With the cup in place, the straps 20*a-c* are threaded through the slits 22*a-c* (FIG. 1) defined by the exterior side of the cup pocket.

Figure 3:
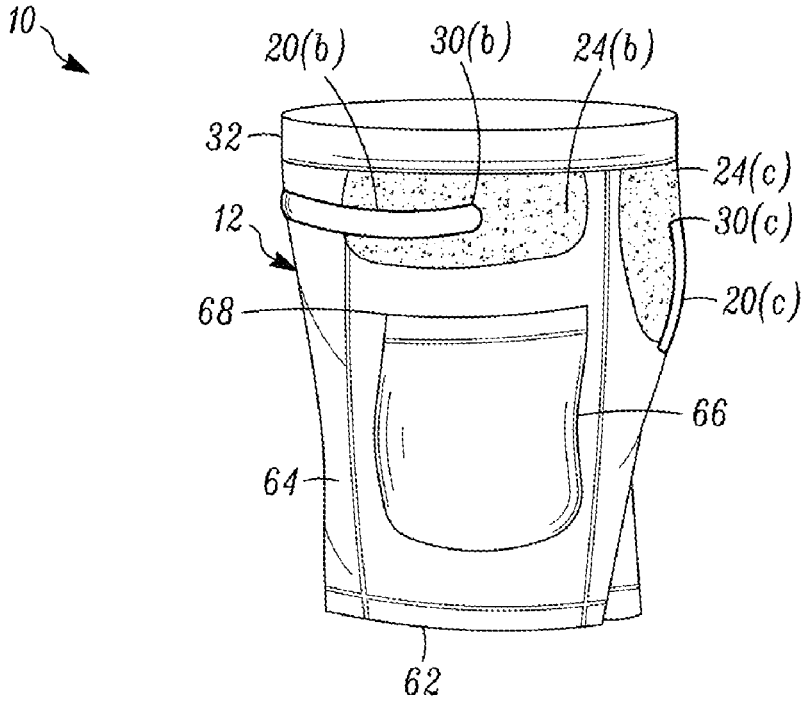
FIG. 3 is a left side view of the undergarment and protective cup system of FIG. 1, depicting an attachment location on an exterior side of the undergarment for a first strap of the protective cup.

With reference now to FIG. 3, the side patches 24*a,b* are disposed on the exterior side of the undergarment 12, proximate to the hips of the wearer below the waistband 32. In the exemplary embodiment, the side patches are generally rectangular to provide ample location and adjustably for securing the straps.

With reference now to FIG. 4, the rear patch 24*c* of loop material is aligned along the centerline on the exterior side of the undergarment 12, below the rear portion of the waistband 32. The rear patch is generally rectangular to provide ample location and adjustably for securing the strap. Thus, the wearer can place the straps in a manner that ensures optimal protection and comfort.

Figure 5:
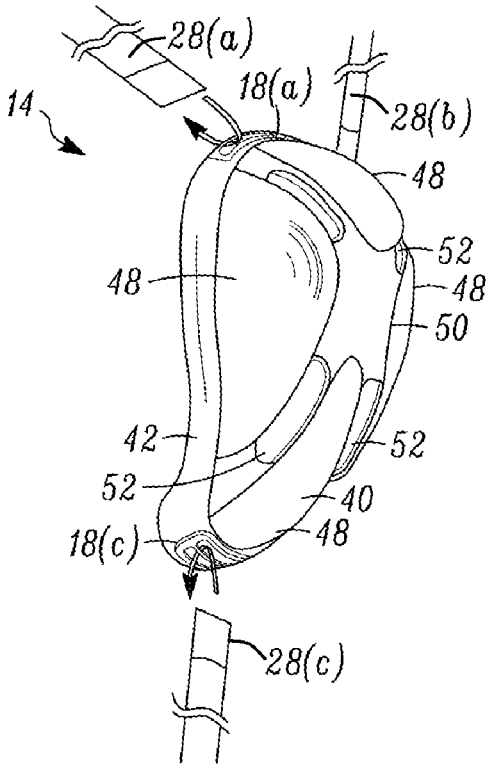
FIG. 5 is a front perspective view of the protective cup of FIG. 1, depicting three straps attached to three peripheral attachment locations defined by a polymer body.
Figure 6:
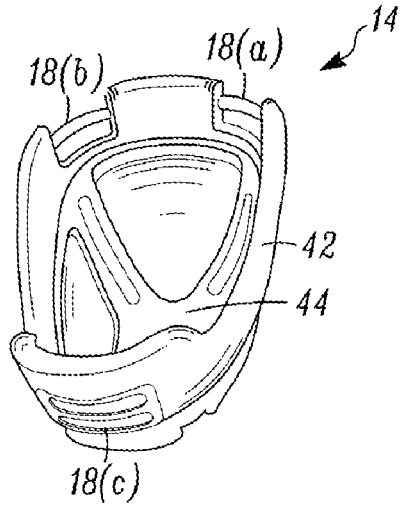
FIG. 6 is a rear perspective view of the protective cup of FIG. 1.
Figure 7:
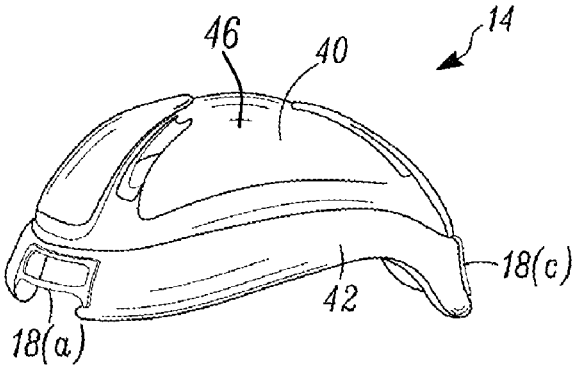
FIG. 7 is a side perspective view of the protective cup of FIG. 1.

With reference now to FIGS. 5-7, the protective cup 14 includes a molded polymer body 40 and a cushion pad 42 disposed about the edge of the body. The polymer body includes a concave interior surface 44 and a convex exterior surface 46. The body is integrally formed and is sized to protect the genitals of a wearer. The body is molded of a rigid thermoplastic material such as polypropylene, high-density polyethylene, polycarbonate, ethylene vinyl acetate, or others. In other embodiments, other materials can be used. The material must be sufficiently strong and durable to endure substantial, repeated impacts without fracture or substantial deformation, such as, metal, composites, carbon fiber materials, and so on. In another embodiment, polypropylene is used.

In the exemplary embodiment, the cushion pad 42 is formed of rubber material molded onto the edge of the body 40. The rubber material can also be disposed in other regions of the protective cup 14. For example, the material can be disposed on the interior surface 44. In other embodiments, cushion material such as silicon, polyvinyl chloride (pvc), ethylene vinyl acetate (eva) foam, foam rubber, and so on. Such cushion material can be disposed on portions, up to substantially all, of the exterior surface of the body.

The body 40 of the protective cup 14 defines the attachment locations 18*a-c* for securing the straps 20 *a-c*. More particularly, the body defines three attachment locations. In the exemplary embodiment, the attachment locations include elongated apertures to allow the straps to thread therethrough. A first location is disposed in a bottom portion of the cup, defining a pair of generally parallel apertures. The second and third locations are in upper left and upper right portions of the cup, respectively, which each define an aperture. In use, the first ends of the straps are each threaded through the apertures.

With continued reference to FIGS. 5 and 7, the exterior surface 46 of the body 40 defines a plurality of raised portions 48. In the still another embodiment, four raised portions are provided disposed in upper, lower, and side quadrants. The raised portions define a generally x-shaped recess 50 between the raised portions. The body further defines four vents 52 located within the recess.

Figure 8:
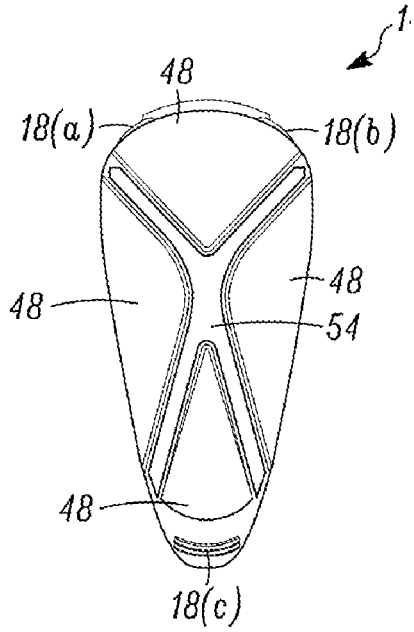
FIG. 8 is a front perspective view of an exemplary embodiment of a protective cup of in accordance with the present invention, depicting a rigid shell disposed within the recess of the cup body.

With reference now to FIG. 8, the protective cup 14 can further include a rigid shell 54 sized to conform within the recess 50 between the raised portions 48. The rigid shell is configured to provide additional protection. As such, the shell can be formed from materials, such as, composite metals, carbon fiber materials, polycarbonates, metals, and so on. The rigid shell can be permanently attached during manufacture, such as via riveting, adhesives, or other means. Alternatively, the protective cup can be configured so that the wearer can removably attach the rigid shell. Removable attachment configurations can include snaps, hook-and-loop material, mechanical snap-fit, clasps, movable guards, to name a few.

With reference again to FIG. 1, the undergarment 12 includes two front panels 60*a,b* attached on opposing sides of the cup pocket 14, extending from the elastic waistband 32 down inner sides of the leg portions to bottom edges 62*a,b* of the undergarment. The front panels are formed of four-way stretch material. The outer panel 26 of the cup pocket is formed of nylon mesh, providing a measure of ventilation.

With reference now to FIG. 3, the undergarment 12 further includes leg panels 64 and side pockets 66 disposed along the outer portion of each leg. Each leg panel is attached to a corresponding front panel. Each pocket is centered between the side seams of the corresponding leg panel and is configured to hold a leg pad (not shown). The side pockets include an opening 68 defined along an upper edge, for receiving the leg pads. Hook-and-loop material is used to secure the opening. The side pockets are disposed on an exterior side of the undergarment and are generally rectangular. In still yet another embodiment, the leg panels and the side pockets are formed of four-way stretch material.

The pockets 66 are configured to receive varying numbers of leg pads, for increased protection, especially as the wearer is approaching a competition. For example, the wearer would use one pad on each leg during regular training. When the competition is a few weeks out, the wearer would add a second pad, and as the competition is a week or so away, they would add a third pad to ensure that no injuries are sustained prior to the competition.

As best seen in FIG. 4, the undergarment 12 further includes two rear panels 70*a,b* formed of four-way stretch material, extending from the elastic waistband 32 to the bottom edges 62*a,b*, respectively. The undergarment can be formed of a variety of materials. In an exemplary embodiment, the undergarment is substantially formed of compression-type material to snuggly fit the wearer. Suitable compression-type materials can have either two-way stretch or four-way stretch such as, cotton, nylon, mesh, polyester, spandex, or other materials known in the art. In other embodiments, all or portions of the undergarment can include non-compressive materials without departing from the invention.

Figure 9:
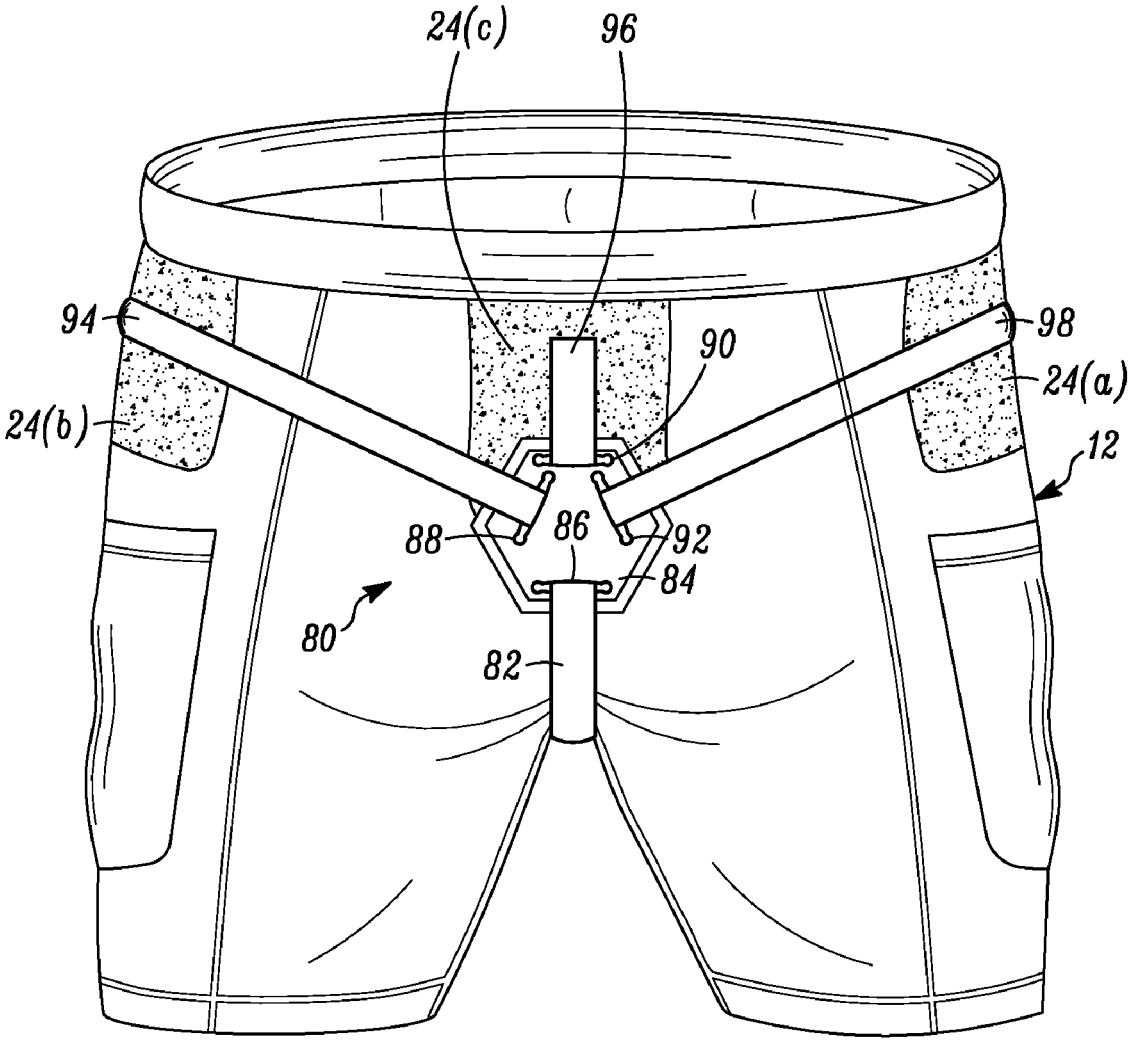
FIG. 9 is a rear perspective view of a second embodiment of an undergarment and protective cup system in accordance with the present invention, depicting a strap assembly having central pad having four attachment slits and three attachment straps radiating therefrom to three attachment locations on the exterior side of the undergarment.

With reference now to FIG. 9, a second embodiment is shown having a strap assembly 80 usable with the undergarment 12 and the protective cup 14 (not shown). A bottom strap 82 extends from the lower cup attachment location 18(*c*) to a central pad 84 to a lower attachment slit 86. The central pad defines four attachment slits (86, 88, 90, 92), three of which are located in an upper portion of the central pad for attaching straps (94, 96, 98). The four straps each loop through a respective attachment slit and attaches unto itself via attachment device, such as hook-and-loop material, snaps, buttons, or other means. The three upper straps (94, 96, 98) include a first portion of hook-and-loop material to attach to the coupling patches (24*a-c*) on the undergarment 12.

In a further embodiment, the straps (86, 94, 96, 98) each include a side having hook material disposed at opposing ends and loop material extending the length of the strap between the hook material at the opposing ends. In use, the first end is looped through the respective attachment slit (86, 88, 90, 92) of the central pad and attaches to the loop material.

In other embodiments, various other configuration can be used to provide a strap that extends from the lower attachment location 18(*c*) of the protective cup 14, between the legs, and terminating in three strap end that attach to the three coupling patches 24(*a-c*) of the undergarment 12. For example, three upper straps can emanate from a buckle, a ring, or other means disposed between the lower attachment location 18(*c*) and the three coupling patches 24(*a-c*).

It should be appreciated from the foregoing that the present invention provides an athletic undergarment and a protective cup assembly. The undergarment includes a cup pocket for holding the protective cup over the groin of the wearer. The cup includes an attachment location in a lower portion to secure a first end of a strap. The cup pocket defines a slit in a bottom portion of the cup pocket sized to allow the strap to pass therethrough. The coupling mechanism is provided having a first portion on the strap and a second portion disposed in a rear portion of the undergarment proximate to the waistband. In use, the strap extends between the legs portions so that the first portion and the second portion of the coupling mechanism can couple in a secure manner to inhibit displacement of the cup when exposed to upward forces.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. An undergarment and protective cup system, comprising:

a protective cup having a concave interior surface sized to protect the genitals of a wearer, the cup having a plurality of attachment locations disposed about the cup, including a first attachment location in a bottom portion of the cup;

a strap assembly having a plurality of straps attached to the plurality of attachment locations of the cup, including a first strap attached to the first attachment location, the strap assembly having a central pad positioned on an exterior side of the undergarment to which a strap extending from the first attachment location of the cup attaches to a lower portion of the central pad and to which a plurality of strap ends attach thereto and extend therefrom to a plurality of coupling regions on the exterior side of the undergarment; and an undergarment defining having a waistband that defines a waist opening and having two leg portions, the undergarment having a cup pocket disposed in the groin region to receive the protective cup, the cup pocket defining a first slit in a bottom portion of an exterior side of the cup pocket sized to allow the strap to pass therethrough, wherein the plurality of coupling regions of the undergarment include a first coupling region in a rear portion of the undergarment, a second region in a left hip portion of the undergarment, and a third region in a right hip portion of the undergarment, the coupling regions and the plurality of straps having coupling mechanisms configured to secure the straps to the coupling regions in a removable manner.

2. An undergarment and protective cup system as defined in claim 1, wherein the coupling mechanisms are formed of hook-and-loop material.

3. An undergarment and protective cup system as defined in claim 1, wherein the protective cup has an integral polymer body that defines the concave interior surface and defines a peripheral edge, and a cushion pad disposed about the peripheral edge, the polymer body having a convex outer surface that defines a plurality of raised portions and a recess disposed between the raised portions, the protective cup further having a rigid shell sized to conform within the recess between the raised portions of the protective cup.

4. An undergarment and protective cup system as defined in claim 1, wherein the plurality of attachment locations include a second attachment location in a upper left portion of the cup and a third attachment locations in a upper right portion of the cup, and wherein the first attachment location of the protective cup defines a pair of elongated apertures disposed proximate to a peripheral edge of the cup, in which the apertures are sized and spaced to allow the first strap to thread therethrough.

5. An undergarment and protective cup system, comprising:

a protective cup having a concave interior surface sized to protect the genitals of a wearer, the cup defining a plurality of attachment locations about the periphery of the cup, including a first attachment location in a bottom portion of the cup, defining a pair of elongated apertures disposed proximate to a peripheral edge of the cup, a second attachment location in a upper left portion of the cup, and a third attachment location in an upper right portion of the cup;

a first strap assembly having a first end attached to the first attachment location of the cup and a second end having a first portion of a hook-and-loop material;

a second strap having a first end attached to the second attachment location of the cup and a second end having a first portion of a hook-and-loop material;

a third strap having a first end attached to the third attachment location of the cup and a second end having a first portion of a hook-and-loop material; and a compressive undergarment defining having a waistband that defines a waist opening and having two leg portions, the compressive undergarment formed of panels of compressive material extending from the waistband and defining bottom edges of the leg portions that encircle the legs of the wearer, the undergarment having a cup pocket disposed in the groin region to receive the protective cup, the cup pocket defining a plurality of slits to allow the straps to pass therethrough, the undergarment having, a rear coupling patch formed of a second portion of hook-and-loop material attached onto an exterior side of the undergarment in a rear portion thereof, proximate to the waistband to secure the first strap, a right hip coupling patch formed of a second portion of hook-and-loop material attached onto the exterior side of a right hip the undergarment proximate to the waistband to secure the second strap, and a left hip coupling patch formed of a second portion of hook-and-loop material attached onto the exterior side of a left hip the undergarment proximate to the waistband to secure the third strap.

6. An undergarment and protective cup system as defined in claim 5, wherein the protective cup has an integral polymer body that defines the concave interior surface and defines a peripheral edge, and a cushion pad disposed about the peripheral edge, the polymer body having a convex outer surface that defines a plurality of raised portions and a recess disposed between the raised portions, the protective cup further having a rigid shell sized to conform within the recess between the raised portions of the protective cup.

7. An undergarment and protective cup system as defined in claim 5, wherein the undergarment defines pockets disposed on the leg portions sized to receive multiple pads.

8. An undergarment and protective cup system as defined in claim 5, wherein the first portions of hook-and-loop material disposed at the second ends of the straps are formed of hook fabric.

9. An undergarment and protective cup system as defined in claim 8, wherein the second portions of hook-and-loop material are formed of loop fabric.

10. An undergarment and protective cup system as defined in claim 5, the first strap having a central pad positioned on an exterior side of the undergarment to which a strap portion extending from the first attachment location of the cup attaches to a lower portion of the central pad and to which a plurality of strap ends attach and extend therefrom to prescribed coupling patches on the exterior side of the undergarment.

11. An undergarment and protective cup system as defined in claim 5, wherein an opening to the cup pocket for inserting the cup is disposed on an interior side of the undergarment.

12. An undergarment and protective cup system including a protective cup sized to protect the genitals of a wearer, the cup having a first attachment location in a bottom portion of the cup, a second attachment location in a upper left portion of the cup, and a third attachment location in an upper right portion of the cup and straps extending from the attachment locations of the cup; a compressive undergarment comprising:

a waistband that defines a waist opening;

a compressive undergarment body formed of compressive material coupled to the waistband, the compressive undergarment body having two leg portions defining bottom edges of the leg portions that encircle the legs of the wearer, the compressive undergarment body having a cup pocket disposed in the groin region to receive the protective cup, the cup pocket defining a plurality of slits to allow straps of the protective cup system to pass therethrough, including a first strap, a second strap, and a third strap, the compressive undergarment body having an exterior side;

a rear coupling patch attached onto the exterior side of the undergarment body in a rear portion thereof, proximate to the waistband to secure the first strap;

a right hip coupling patch attached onto the exterior side of the undergarment body proximate to the right hip and the waistband to secure the second strap; and a left hip coupling patch attached onto the exterior side of the undergarment body proximate to the left hip and the waistband to secure the third strap.

13. An undergarment and protective cup system as defined in claim 12, wherein an opening to the cup pocket for inserting the cup is disposed on an interior side of the undergarment.

14. An undergarment and protective cup system as defined in claim 12, wherein the undergarment body defines pockets disposed on the leg portions sized to receive multiple pads.

15. An undergarment and protective cup system as defined in claim 12, wherein the rear coupling patch, the right hip coupling patch, and the left hip coupling patch are formed of loop fabric to couple with hook fabric disposed on the straps of the protective cup.

16. An undergarment and protective cup system as defined in claim 12, wherein the compressive undergarment body is formed of panels of compressive material extending from the waistband and defining bottom edges of the leg portions that encircle the legs of the wearer.

17. An undergarment and protective cup system as defined in claim 16, wherein the rear coupling patch, the right hip coupling patch, and the left hip coupling patch are formed of loop fabric to couple with hook fabric disposed on the straps of the protective cup.

* * * * *